US005476169A

United States Patent [19]

Takarada et al.

[11] Patent Number: 5,476,169

[45] Date of Patent: Dec. 19, 1995

[54] BILL DISCRIMINATING APPARATUS FOR BILL HANDLING MACHINE

[75] Inventors: Yuji Takarada, Kawabe; Takao Akioka, Sanda; Hiroyuki Ikeda, Higashi-Osaka; Shigeru Yonetani, Yamatotakada; Akio Funato, Kyoto, all of Japan

[73] Assignee: Laurel Bank Machines Co., Ltd., Tokyo, Japan

[21] Appl. No.: 385,548

[22] Filed: Feb. 8, 1995

[30] Foreign Application Priority Data

Feb. 15, 1994 [JP] Japan ..... 6-018748
Jan. 20, 1995 [JP] Japan ..... 7-007529

[51] Int. Cl.[6] ..... G07D 7/00

[52] U.S. Cl. ..... 194/207; 250/461.1

[58] Field of Search ..... 194/205, 206, 194/207; 250/372, 458.1, 461.1

[56] References Cited

U.S. PATENT DOCUMENTS

| | | | |
|---|---|---|---|
| 4,023,011 | 5/1977 | Nakajima et al. | 194/207 X |
| 4,114,804 | 9/1978 | Jones et al. | 250/372 X |
| 4,277,774 | 7/1981 | Fujii et al. | 194/207 X |
| 4,558,224 | 12/1985 | Gober | 250/461.1 |
| 5,280,333 | 1/1994 | Wunderer | 250/458.1 X |
| 5,374,825 | 12/1994 | Doty et al. | 250/372 |

FOREIGN PATENT DOCUMENTS

| | | | |
|---|---|---|---|
| 2250671 | 4/1973 | Germany | 194/207 |
| 1336063 | 9/1987 | U.S.S.R. | 194/207 |

*Primary Examiner*—Michael S. Huppert
*Assistant Examiner*—Scott L. Lowe
*Attorney, Agent, or Firm*—Cushman, Darby & Cushman

[57] ABSTRACT

A bill discriminating apparatus for a bill handling machine including an ultraviolet ray lamp for emitting ultraviolet rays toward bills, a light detector for photoelectrically detecting visible light emitted from phosphor materials contained in bills upon being irradiated with ultraviolet rays and producing visible light detection signals, a visible light detection signal amplifier for amplifying the visible light detection signals produced by the light detector, an ultraviolet ray detector for photoelectrically detecting ultraviolet rays emitted from the ultraviolet ray lamp and producing ultraviolet ray detection signals, a CPU for receiving the visible light detection signals amplified by the visible light detection signal amplifier and the ultraviolet ray detection signals produced by the ultraviolet ray detector and discriminating bills, the CPU adjusting an amplifying factor of the visible light detection signal amplifier in accordance with levels of ultraviolet ray detection signals input from the ultraviolet ray detector. According to this bill discriminating apparatus for a bill handling machine, it is possible to discriminate a denomination of a bill and whether or not a bill is acceptable with high accuracy.

12 Claims, 2 Drawing Sheets

BILL DISCRIMINATING APPARATUS FOR BILL HANDLING MACHINE

BACKGROUND OF THE INVENTION

The present invention relates to a bill discriminating apparatus for a bill handling machine and, in particular, to such an apparatus for irradiating a bill with ultraviolet rays, detecting visible light emitted from phosphor materials contained in the bill and discriminating the denomination of the bill and whether or not the bill is acceptable.

DESCRIPTION OF THE PRIOR ART

A bill handling machine such as a bill counting machine or the like normally includes a bill discriminating apparatus for discriminating the denomination of bills and whether or not bills are acceptable.

In the conventional bill discriminating apparatus, the denomination of a bill and whether or not a bill is acceptable are discriminated by detecting magnetic materials contained in ink in printed portions on the bill or detecting a pattern, a shade of color of the bill or the like with a photosensor.

Since color copying machines have come into wide use and printing technology has advanced markedly, however, counterfeiters are now able to make sophisticated imitations. It has been therefore become difficult to accurately discriminate bills by such methods.

Under these circumstances, in order to discriminate counterfeit bills without fail, phosphor materials which emit visible light upon being irradiated with ultraviolet rays are mixed with ink and bills are printed using such ink.

U.S. Pat. No. 4,277,774 proposes a bill discriminating apparatus for discriminating the denomination of bills and whether or not bills are acceptable by utilizing a property of a phosphor material which emits visible light upon being irradiated with ultraviolet rays.

In this bill discriminating apparatus, a bill to be discriminated is irradiated with ultraviolet rays emitted from an ultraviolet ray source, visible light emitted from phosphor materials is photoelectrically detected by a photoelectric detecting element, and the denomination of the bill and whether or not a bill is acceptable are discriminated based upon the thus obtained detection signal.

However, the amount of ultraviolet rays emitted from the ultraviolet ray source varies greatly depending upon temperature and when the temperature becomes low, the amount of ultraviolet rays becomes low and the amount of visible light emitted from the phosphor materials also becomes low, whereby the level of the detection signal becomes low. It, therefore, becomes difficult to discriminate bills based on the detection signal.

SUMMARY OF THE INVENTION

It is therefore an object of the present invention to provide a bill discriminating apparatus for a bill handling machine which can discriminate bill denomination and bill acceptability with high accuracy.

The above and other objects of the present invention can be accomplished by a bill discriminating apparatus for a bill handling machine comprising ultraviolet ray irradiating means for irradiating bills with ultraviolet rays, light detecting means for photoelectrically detecting visible light emitted from phosphor materials contained in bills upon being irradiated with ultraviolet rays and producing visible light detection signals, visible light detection signal amplifying means for amplifying the visible light detection signals produced by the light detecting means, ultraviolet ray detecting means for photoelectrically detecting ultraviolet rays emitted from the ultraviolet ray irradiating means and producing ultraviolet ray detection signals, bill discriminating means for receiving the visible light detection signals amplified by the visible light detection signal amplifying means and the ultraviolet ray detection signals produced by the ultraviolet ray detecting means and discriminating bills, the bill discriminating means being adapted for adjusting the amplifying factor of the visible light detection signal amplifying means in accordance with the levels of ultraviolet ray detection signals received from the ultraviolet ray detecting means.

In a preferred aspect of the present invention, a bill discriminating apparatus for a bill handling machine further comprises ultraviolet ray detection signal amplifying means for amplifying the ultraviolet ray detection signals produced by the ultraviolet ray detecting means and outputting the amplified ultraviolet ray detection signals to the bill discriminating means.

In a further preferred aspect of the present invention, the bill discriminating means is adapted to store, as a threshold level, a level which is lower than the level of the ultraviolet ray detection signal produced by the ultraviolet ray detecting means and input into the bill discriminating means when the amount of ultraviolet rays emitted from the ultraviolet ray irradiating means is minimum and greater than the maximum level of the ultraviolet ray detection signal produced by the ultraviolet ray detecting means based on the amount of ultraviolet rays transmitted through a bill and input into the bill discriminating means when the amount of ultraviolet rays emitted from the ultraviolet ray irradiating means is maximum, and to adjust the amplifying factor of the visible light detection signal amplifying means in accordance with the level of the input ultraviolet ray detection signal only when the input ultraviolet ray detection signal exceeds the threshold level.

In a further preferred aspect of the present invention, a bill discriminating apparatus for a bill handling machine further comprises amplifying factor adjusting means for adjusting the amplifying factor of the visible light detection signal amplifying means and the bill discriminating means is adapted to output amplifying factor adjusting signals to the amplifying factor adjusting means in accordance with levels of the input ultraviolet ray detection signals and the amplifying factor adjusting means is adapted to adjust the amplifying factor of the visible light detection signal amplifying means in accordance with the amplifying factor adjusting signals input from the bill discriminating means.

In a still further preferred aspect of the present invention, the bill discriminating means is adapted to store, as a threshold level, a level which is lower than the level of the ultraviolet ray detection signal produced by the ultraviolet ray detecting means and input into the bill discriminating means when the amount of ultraviolet rays emitted from the ultraviolet ray irradiating means is minimum and greater than the maximum level of the ultraviolet ray detection signal produced by the ultraviolet ray detecting means based on the amount of ultraviolet rays transmitted through a bill and input into the bill discriminating means when the amount of ultraviolet rays emitted from the ultraviolet ray irradiating means is maximum, and to output an amplifying factor adjusting signal to the amplifying factor adjusting means in accordance with the level of the input ultraviolet ray detection signal only when the input ultraviolet ray detection signal exceeds the threshold level.

In a yet further preferred aspect of the present invention, the bill discriminating means is adapted to accept visible light detection signals from the visible light detection signal amplifying means only when the input ultraviolet ray detection signals are equal to or lower than the threshold level.

The above and other objects and features of the present invention will become apparent from the following description made with reference to the accompanying drawings.

DESCRIPTION OF THE PREFERRED EMBODIMENTS

Figure 1:
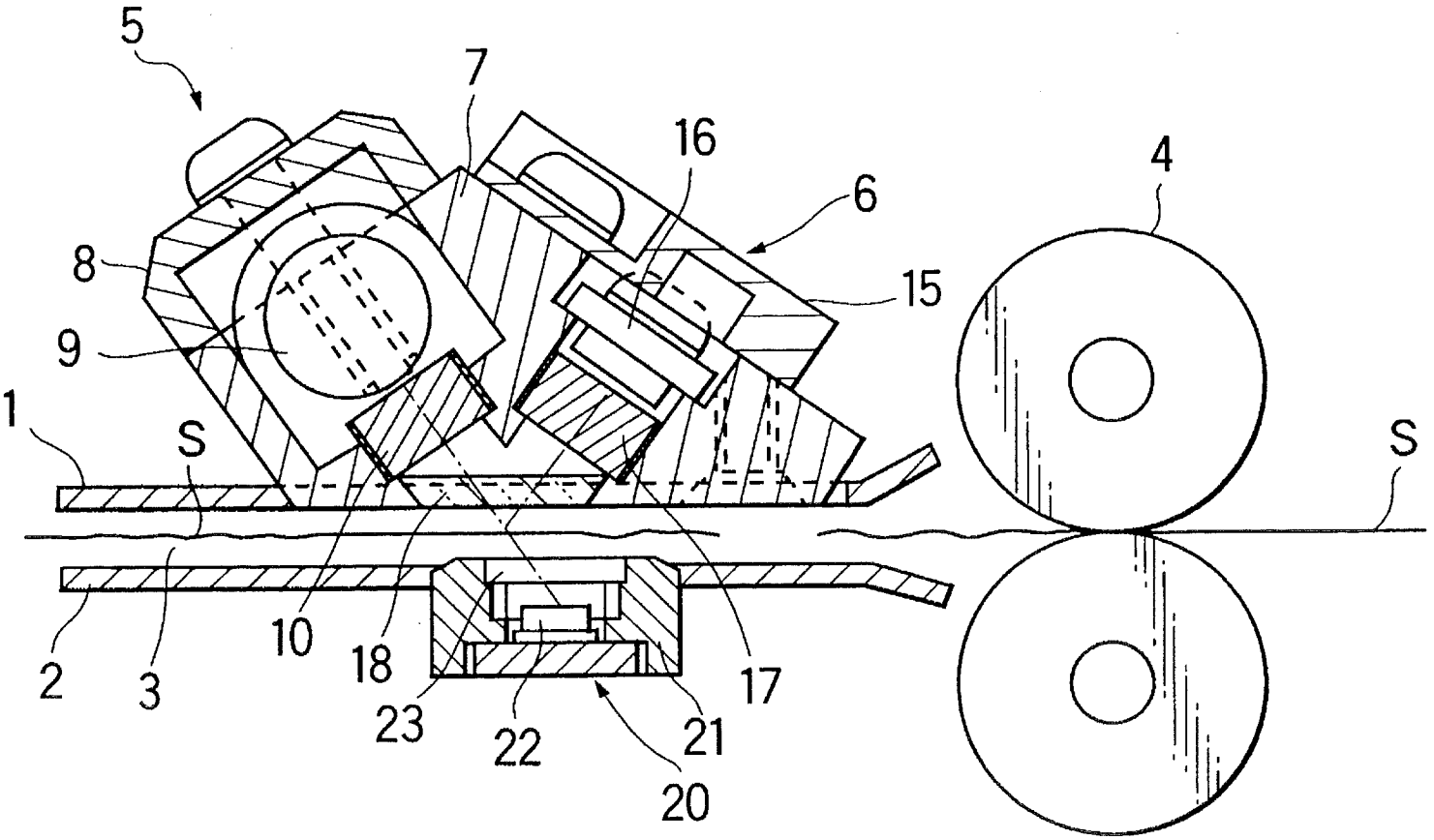
FIG. 1 is a schematic cross-sectional view of a bill discriminating apparatus for a bill handling machine which is an embodiment of the present invention.

As shown in FIG. 1, a bill discriminating apparatus includes a pair of guide plates 1, 2 which are spaced from each other at a small distance to form a bill passage 3. Bills S are transported along the bill passage 3 one by one by transporting rollers 4.

The guide plate 1 is provided thereon with an ultraviolet ray irradiating means 5 for irradiating bills with ultraviolet rays and a light detector 6 for photoelectrically detecting visible light emitted from phosphor materials contained in the bills S upon being irradiated with ultraviolet rays.

The ultraviolet ray irradiating means 5 comprises a casing 8 integrally formed with a holder 7 constituting a part of a body of a bill handling machine (not shown), an ultraviolet ray lamp 9 accommodated in the casing 8 for emitting ultraviolet rays and a filter 10 provided in front of the ultraviolet ray lamp 9 for selectively passing only ultraviolet rays.

The light detector 6 comprises a casing 15 integrally formed with the holder 7, a photodiode 16 accommodated in the casing 15 for photoelectrically detecting visible light emitted from the phosphor materials contained in the bills S upon being irradiated with ultraviolet rays and outputting a visible light detection signal and a filter 17 provided in front of the photodiode 16 for selectively passing only visible light. The photodiode 16 outputs a visible light detection signal of a level proportional to the amount of received visible light.

The portion of the guide plate 1 in a light path of ultraviolet rays emitted from the ultraviolet ray lamp 9 is formed with an opening into which a transparent dust-proof glass 18 for allowing passage of ultraviolet rays and visible light but preventing dust and the like from entering the ultraviolet ray irradiating means 5 and the light detector 6.

An ultraviolet ray detecting means 20 is mounted on the guide plate 2 forming the bottom portion of the bill passage 3. The ultraviolet ray detecting means 20 comprises a casing 21 fixed to the guide plate 2 and an ultraviolet ray sensor 22 accommodated in the casing 21 and disposed in a light path of ultraviolet rays emitted from the ultraviolet ray lamp 9 for detecting ultraviolet rays. A photodiode with sensitivity to rays of ultraviolet wavelength is employed as the ultraviolet ray sensor 22 and outputs an ultraviolet ray detection signal of a level proportional to the amount of received ultraviolet rays.

The portion of the guide plate 2 in a light path of ultraviolet rays emitted from the ultraviolet ray lamp 9 is formed with an opening into which a transparent dust-proof glass 23 for allowing passage of ultraviolet rays but preventing dust and the like from entering the ultraviolet ray detecting means 20.

Figure 2:
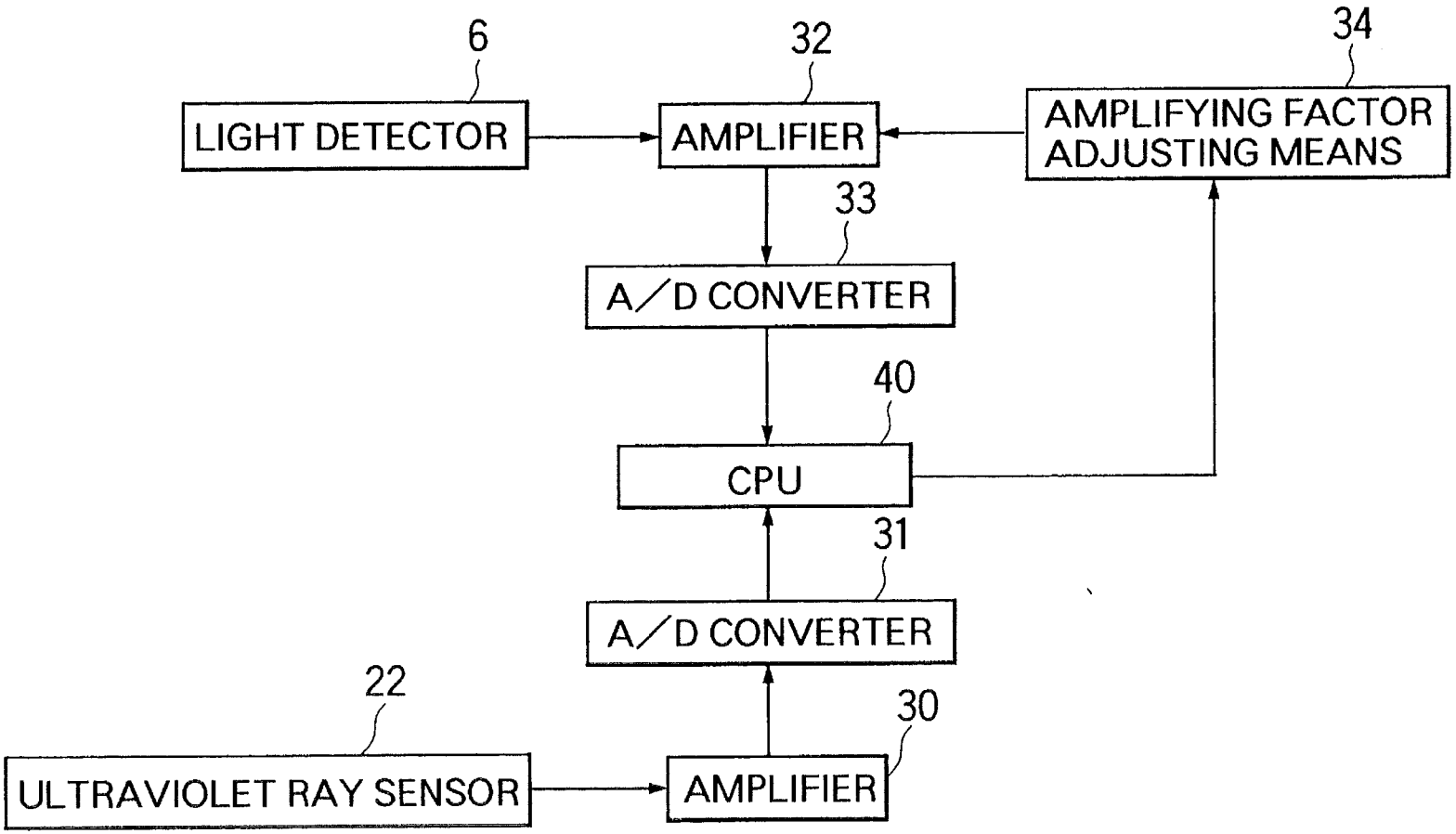
FIG. 2 is a block diagram of a detection system of a bill discriminating apparatus which is an embodiment of the present invention.

FIG. 2 is a block diagram of a detection system of a bill discriminating apparatus which is an embodiment of the present invention.

A detection system of the bill discriminating apparatus comprises an amplifier 30 for amplifying the ultraviolet ray detection signals produced by the ultraviolet ray sensor 22, an A/D converter 31 for converting the ultraviolet ray detection signals amplified by the amplifier 30 into digital signals, an amplifier 32 for amplifying the visible light detection signals produced by the light detector 6, an A/D converter 33 for converting the visible light detection signals into digital signals, a amplifying factor adjusting means 34 for adjusting the amplifying factor of the amplifier 32 and a CPU 40 for receiving the ultraviolet ray detection signals amplified by the amplifier 30 and digitized by the A/D converter 31, outputting amplifying factor adjusting signals to the amplifying factor adjusting means 34, thereby causing it to adjust the amplifying factor of the amplifier 32, receiving visible light signals amplified by the amplifier 32 and digitized by the A/D converter 33 and discriminating the denominations of bills S and whether or not bills S are acceptable.

The amounts of visible light emitted from phosphor materials contained in each denomination of the bills S upon being irradiated with ultraviolet rays are measured in advance and stored as reference data in the CPU 40. Further, optimum amplifying factors are determined in advance in correspondence to the levels of the ultraviolet ray detection signals produced by the ultraviolet ray sensor 22, amplified by the amplifier 30 and digitized by the A/D converter 31, and the so-determined optimum amplifying factors are stored in the CPU 40 in the form of a signal level-amplifying factor table. When a bill S is present in the path of the ultraviolet rays emitted from the ultraviolet lamp 9, only the ultraviolet rays transmitted through the bill S are detected by the ultraviolet ray sensor 22. Since the amount of the ultraviolet rays received by the ultraviolet ray sensor 22 therefore falls to a very low level, the level of the ultraviolet ray detection signal amplified by the amplifier 30 and digitized by the A/D converter 31 also becomes very low. In this case, if the amplifying factor of the amplifier 32 is adjusted based on an amplifying factor adjusting signal output to the amplifying factor adjusting means 34 in accordance with the level of the ultraviolet signal input from the A/D converter 31, the visible light detection signal produced by the light detector 6 is undesirably amplified resulting in erroneous discrimination of the denomination of the bill S and whether or not the bill S is acceptable. Therefore, in this embodiment, a threshold level is set so as to be lower than the level of the ultraviolet ray detection signal produced by the ultraviolet ray sensor 22, amplified by the amplifier 30 and digitized by the A/D converter 31 based upon the ultraviolet rays detected by the ultraviolet ray sensor 22 when the amount of ultraviolet rays emitted from the ultraviolet ray lamp 9 becomes minimum due to a change in temperature and greater than the maximum level of the ultraviolet ray detection signal produced by the ultraviolet ray sensor 22, amplified by the amplifier 30 and digitized by the A/D converter 31 based upon ultraviolet rays transmitted through a bill S and detected by the ultraviolet ray sensor 22 when the amount of ultraviolet rays emitted from the ultraviolet ray lamp 9 becomes maximum due to a change in temperature, and is stored in the CPU 40 so that when the level of the ultraviolet ray detection signal input from the A/D converter 31 is equal to or lower than the threshold level, the CPU 40 outputs no amplifying factor adjusting signal.

The thus constituted bill discriminating apparatus discriminates denominations of bills S and whether or not bills S are acceptable in the following manner.

The CPU 40 judges whether or not the level of the ultraviolet ray detection signal produced by the ultraviolet ray sensor 22, amplified by the amplifier 30 and digitized by the A/D converter 31 is equal to or lower than the threshold level.

When the discrimination operation is started, since no bill S has yet been fed to the bill discriminating apparatus, the ultraviolet rays emitted from the ultraviolet ray lamp 9 are not obstructed by a bill and, therefore, the level of the ultraviolet ray detection signal exceeds the threshold level.

Accordingly, the CPU 40 determines the amplifying factor of the amplifier 32 based upon the level of the ultraviolet ray detection signal input from the A/D converter 31 in accordance with the signal level-amplifying factor table stored therein, and outputs an amplifying factor adjusting signal to the amplifying factor adjusting means 34. The amplifying factors are set to be greater as the level of the ultraviolet ray detection signal is lower and to be smaller as the level of the ultraviolet ray detection signal is higher.

The amplifying factor adjusting means 34 determines the amplifying factor of the amplifier 32 in accordance with the amplifying factor adjusting signal received from the CPU 40.

When the level of the ultraviolet ray detection signal produced by the ultraviolet ray sensor 22, amplified by the amplifier 30 and digitized by the A/D converter 31 is equal to or lower than the threshold level, since no bill S has been fed to the bill discriminating apparatus, the CPU 40 does not accept any visible light detection signal from the light detector 6.

Thus, the CPU 40 continues judging whether or not the level of the ultraviolet ray detection signal produced by the ultraviolet ray sensor 22, amplified by the amplifier 30 and digitized by the A/D converter 31 is equal to or lower than the threshold level and when it judges that the level of the ultraviolet ray detection signal has become equal to or lower than the threshold level, it starts to accept visible light detection signals produced by the light detector 6, amplified by the amplifier 32 and digitized by the A/D converter 33.

When the level of the ultraviolet ray detection signal produced by the ultraviolet ray sensor 22, amplified by the amplifier 30 and digitized by the A/D converter 31 exceeds the threshold level, the CPU 40 stops accepting visible light detection signals and, based upon the thus received visible light detection signals and the reference data stored therein, discriminates the denomination of the bill S and whether or not the bill S is acceptable.

According to the above described embodiment, since the CPU 40 outputs an amplifying factor adjusting signal to the amplifying signal adjusting means 34 in accordance with the amount of ultraviolet rays emitted from the ultraviolet ray lamp 9, thereby setting the amplifying factor of the amplifier 32 for amplifying visible light detecting signals from the light detector 6 for photoelectrically detecting visible light emitted from phosphor materials contained in the bills S to an optimum value, even if the amount of ultraviolet rays emitted from the ultraviolet ray lamp 9 varies due to a change in temperature, it is nevertheless always possible for the CPU 40 to receive visible light detection signals whose levels equal to those of visible light detection signals obtained by detecting visible light emitted from phosphor materials contained in a bill S when a bill S is irradiated with a constant amount of ultraviolet rays.

Further, according to the above described embodiment, the threshold level is set and if the level of an ultraviolet ray detection signal input from the A/D converter 31 is equal to or lower than the threshold level, the CPU 40 does not output an amplifying factor adjusting signal. Therefore, when ultraviolet rays emitted from the ultraviolet ray lamp 9 is obstructed by a bill S and the detected amount of ultraviolet rays is low independent of any change in the amount of emitted ultraviolet rays, the amplifying factor of the amplifier 32 can be prevented from being adjusted to be improper value, thereby effecting the discrimination of bills S with high accuracy. Moreover, since acceptance of visible light detection signals is started when the level of the ultraviolet ray detection signal becomes equal to or lower than the threshold level and it is terminated when the level of the ultraviolet ray detection signal exceeds the threshold level, it is unnecessary to provide an independent means for detecting the times for accepting visible light detection signals, whereby the apparatus does not become unecessarily complicated.

The present invention has thus been shown and described with reference to specific embodiments. However, it should be noted that the present invention is in no way limited to the details of the described arrangements but changes and modifications may be made without departing from the scope of the appended claims.

For example, although the above described embodiment provides with the amplifying factor adjusting means 34 for adjusting the amplifying factor of the amplifier 32, if a variable amplifier capable of varying its amplifying factor is employed as the amplifier 32 and the amplifying factor adjusting signal can be directly input thereinto from the CPU 40, it is possible to omit the amplifying factor adjusting means 34.

Further, in the above described embodiment, although the ultraviolet ray detecting means 20 is mounted on the guide plate 2 forming the bottom portion of the bill passage 3, the position of the ultraviolet ray detecting means 20 can be arbitrarily selected at any point where the ultraviolet rays emitted from the ultraviolet ray lamp 9 can be detected.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a bill discriminating apparatus for a bill handling machine which can discriminate the denomination of a bill and whether or not the bill is acceptable with high accuracy.

We claim:

1. A bill discriminating apparatus for a bill handling machine comprising ultraviolet ray irradiating means for irradiating bills with ultraviolet rays, light detecting means for photoelectrically detecting visible light emitted from phosphor materials contained in bills upon being irradiated with ultraviolet rays and producing visible light detection signals, visible light detection signal amplifying means for amplifying the visible light detection signals produced by the light detecting means, ultraviolet ray detecting means for photoelectrically detecting ultraviolet rays emitted from the ultraviolet ray irradiating means and producing ultraviolet ray detection signals, bill discriminating means for receiving the visible light detection signals amplified by the visible light detection signal amplifying means and the ultraviolet ray detection signals produced by the ultraviolet ray detecting means and discriminating bills, the bill discriminating means being adapted for adjusting an amplifying factor of the visible light detection signal amplifying means in accordance with levels of ultraviolet ray detection signals input from the ultraviolet ray detecting means.

2. A bill discriminating apparatus for a bill handling machine in accordance with claim 1 wherein the bill discriminating means is adapted to store, as a threshold level, a level which is lower than a level of the ultraviolet ray detection signal produced by the ultraviolet ray detecting means and input into the bill discriminating means when an amount of ultraviolet rays emitted from the ultraviolet ray irradiating means is minimum and greater than a maximum level of the ultraviolet ray detection signal produced by the ultraviolet ray detecting means based on an amount of ultraviolet rays transmitted through a bill and input into the bill discriminating means when an amount of ultraviolet rays emitted from the ultraviolet ray irradiating means is maximum, and to adjust the amplifying factor of the visible light detection signal amplifying means in accordance with the level of the input ultraviolet ray detection signal only when the input ultraviolet ray detection signal exceeds the threshold level.

3. A bill discriminating apparatus for a bill handling machine in accordance with claim 2 wherein the bill discriminating means is adapted to accept visible light detection signals from the visible light detection signal amplifying means only when input ultraviolet ray detection signals are equal to or lower than the threshold level.

4. A bill discriminating apparatus for a bill handling machine in accordance with claim 1 which further comprises amplifying factor adjusting means for adjusting an amplifying factor of the visible light detection signal amplifying means and wherein the bill discriminating means is adapted to output amplifying factor adjusting signals to the amplifying factor adjusting means in accordance with levels of the input ultraviolet ray detection signals and the amplifying factor adjusting means is adapted to adjust the amplifying factor of the visible light detection signal amplifying means in accordance with the amplifying factor adjusting signals input from the bill discriminating means.

5. A bill discriminating apparatus for a bill handling machine in accordance with claim 4 wherein the bill discriminating means is adapted to store, as a threshold level, a level which is lower than a level of the ultraviolet ray detection signal produced by the ultraviolet ray detecting means and input into the bill discriminating means when an amount of ultraviolet rays emitted from the ultraviolet ray irradiating means is minimum and greater than a maximum level of the ultraviolet ray detection signal produced by the ultraviolet ray detecting means based on an amount of ultraviolet rays transmitted through the bill and input into the bill discriminating means when an amount of ultraviolet rays emitted from the ultraviolet ray irradiating means is maximum, and to output an amplifying factor adjusting signal to the amplifying factor adjusting means in accordance with the level of the input ultraviolet ray detection signal only when the input ultraviolet ray detection signal exceeds the threshold level.

6. A bill discriminating apparatus for a bill handling machine in accordance with claim 5 wherein the bill discriminating means is adapted to accept visible light detection signals from the visible light detection signal amplifying means only when input ultraviolet ray detection signals are equal to or lower than the threshold level.

7. A bill discriminating apparatus for a bill handling machine in accordance with claim 1 which further comprises ultraviolet ray detection signal amplifying means for amplifying the ultraviolet ray detection signals produced by the ultraviolet ray detecting means and outputting the amplified ultraviolet ray detection signals to the bill discriminating means.

8. A bill discriminating apparatus for a bill handling machine in accordance with claim 7 wherein the bill discriminating means is adapted to store, as a threshold level, a level which is lower than a level of the ultraviolet ray detection signal produced by the ultraviolet ray detecting means and input into the bill discriminating means when an amount of ultraviolet rays emitted from the ultraviolet ray irradiating means is minimum and greater than a maximum level of the ultraviolet ray detection signal produced by the ultraviolet ray detecting means based on an amount of ultraviolet rays transmitted through a bill and input into the bill discriminating means when an amount of ultraviolet rays emitted from the ultraviolet ray irradiating means is maximum, and to adjust the amplifying factor of the visible light detection signal amplifying means in accordance with the level of the input ultraviolet ray detection signal only when the input ultraviolet ray detection signal exceeds the threshold level.

9. A bill discriminating apparatus for a bill handling machine in accordance with claim 8 wherein the bill discriminating means is adapted to accept visible light detection signals from the visible light detection signal amplifying means only when input ultraviolet ray detection signals are equal to or lower than the threshold level.

10. A bill discriminating apparatus for a bill handling machine in accordance with claim 7 which further comprises amplifying factor adjusting means for adjusting an amplifying factor of the visible light detection signal amplifying means and wherein the bill discriminating means is adapted to output amplifying factor adjusting signals to the amplifying factor adjusting means in accordance with levels of the input ultraviolet ray detection signals and the amplifying factor adjusting means is adapted to adjust the amplifying factor of the visible light detection signal amplifying means in accordance with the amplifying factor adjusting signals input from the bill discriminating means.

11. A bill discriminating apparatus for a bill handling machine in accordance with claim 10 wherein the bill discriminating means is adapted to store, as a threshold level, a level which is lower than a level of the ultraviolet ray detection signal produced by the ultraviolet ray detecting means and input into the bill discriminating means when an amount of ultraviolet rays emitted from the ultraviolet ray irradiating means is minimum and greater than a maximum level of the ultraviolet ray detection signal produced by the ultraviolet ray detecting means based on an amount of ultraviolet rays transmitted through the bill and input into the bill discriminating means when an amount of ultraviolet rays emitted from the ultraviolet ray irradiating means is maximum, and to output an amplifying factor adjusting signal to the amplifying factor adjusting means in accordance with the level of the input ultraviolet ray detection signal only when the input ultraviolet ray detection signal exceeds the threshold level.

12. A bill discriminating apparatus for a bill handling machine in accordance with claim 11 wherein the bill discriminating means is adapted to accept visible light detection signals from the visible light detection signal amplifying means only when input ultraviolet ray detection signals are equal to or lower than the threshold level.

* * * * *